US010947802B2

(12) United States Patent
Hrupp

(10) Patent No.: US 10,947,802 B2
(45) Date of Patent: Mar. 16, 2021

(54) MECHANICAL PERFORATOR

(71) Applicant: Exacta-Frac Energy Services, Inc., Conroe, TX (US)

(72) Inventor: Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 203 days.

(21) Appl. No.: 16/155,057

(22) Filed: Oct. 9, 2018

(65) Prior Publication Data

US 2020/0109613 A1 Apr. 9, 2020

(51) Int. Cl.
*E21B 29/00* (2006.01)
*E21B 23/01* (2006.01)
*E21B 43/112* (2006.01)

(52) U.S. Cl.
CPC ..... *E21B 29/005* (2013.01); *E21B 23/01* (2013.01); *E21B 43/112* (2013.01)

(58) Field of Classification Search
CPC ..... E21B 23/01; E21B 23/04; E21B 23/0411; E21B 29/00; E21B 29/005; E21B 43/112; E21B 43/11855
See application file for complete search history.

(56) References Cited

U.S. PATENT DOCUMENTS 904,657 A * 11/1908 Stephens ..... E21B 43/112 166/55.3
1,015,432 A * 1/1912 Frederickson ..... E21B 43/112 166/55.3
1,433,722 A * 10/1922 Hinderliter ..... E21B 29/00 166/55.2
1,644,637 A * 10/1927 Darling ..... E21B 43/112 166/55.2
1,731,553 A * 10/1929 Van Keulen ..... E21B 29/00 166/55.2
1,776,025 A * 9/1930 Hinderliter ..... E21B 29/00 166/55.2
1,779,652 A 10/1930 Wood
1,786,590 A 12/1930 Althausen
1,789,993 A 1/1931 Switzer
1,896,104 A * 2/1933 Simmons ..... E21B 17/08 166/287
1,941,703 A * 1/1934 Martois ..... E21B 29/005 166/55.7
1,959,284 A * 5/1934 Clark ..... E21B 29/005 166/55.7
2,019,450 A 8/1936 Johnson
2,066,767 A * 1/1937 Church ..... E21B 29/005 285/391

(Continued)

FOREIGN PATENT DOCUMENTS

CA 2842568 A1 * 5/2014 ..... E21B 34/16
CA 2924345 A1 * 5/2015 ..... E21B 41/00

(Continued)

*Primary Examiner* — Jennifer H Gay
(74) *Attorney, Agent, or Firm* — J. Bennett Mullinax, LLC

(57) ABSTRACT

A mechanical perforator includes a perforator module and a slip module. The perforator module has perforator blades that may be forced outwardly to perforate a well casing joint after slips of the slip module has been deployed to bite the well casing and anchor a lower end of the mechanical perforator in the well casing.

17 Claims, 5 Drawing Sheets

(56) References Cited

U.S. PATENT DOCUMENTS 2,118,242 A * 5/1938 Thomas ..... E21B 29/005 166/55.7
2,202,986 A * 6/1940 Ellis ..... E21B 29/005 166/55.7
2,203,011 A * 6/1940 Ellis ..... E21B 29/005 166/55.7
2,322,695 A * 6/1943 Kinzbach ..... B23B 5/162 166/55.8
2,328,782 A 9/1943 Bynum
2,330,265 A * 9/1943 Burt ..... E21B 23/065 166/63
2,525,007 A 10/1950 Worden et al.
2,537,284 A * 1/1951 Schuder ..... E21B 17/08 285/319
2,638,165 A * 5/1953 Barber ..... E21B 43/112 166/55.2
2,640,537 A * 6/1953 Edwards ..... E21B 29/005 166/55.8
2,690,217 A * 9/1954 Robishaw ..... E21B 29/005 166/55.8
2,690,218 A * 9/1954 Robishaw ..... E21B 29/005 166/377
2,705,998 A * 4/1955 Spang ..... E21B 29/00 166/55.3
2,709,490 A * 5/1955 Trimble ..... E21B 29/06 166/55.8
2,725,936 A 12/1955 Hester
2,741,316 A * 4/1956 Long ..... E21B 47/09 166/63
2,743,906 A 5/1956 Coyle
2,746,550 A * 5/1956 Mitchell, Jr. ..... E21B 19/00 166/255.1
2,753,935 A * 7/1956 Fredd ..... E21B 43/112 166/55.2
2,859,943 A 11/1958 Chadderdon
2,991,834 A * 7/1961 Kennard ..... E21B 31/16 166/55.7
2,999,542 A * 9/1961 Myers ..... E21B 47/09 166/64
3,037,797 A * 6/1962 Brown ..... E21B 43/14 285/18
3,211,221 A 10/1965 Huitt
3,283,405 A * 11/1966 Braswell ..... E21B 29/005 30/103
3,331,439 A 7/1967 Sanford
3,344,862 A * 10/1967 Conrad ..... E21B 29/00 166/216
3,366,179 A * 1/1968 Kinley ..... E21B 43/11855 166/55.3
3,419,077 A * 12/1968 Lawrence ..... E21B 29/005 166/55.8
3,447,604 A * 6/1969 Anderson ..... E21B 43/11855 166/63
3,468,386 A * 9/1969 Johnson ..... E21B 43/117 175/4.6
4,068,711 A 1/1978 Aulenbacher
4,106,561 A 8/1978 Jerome et al.
4,165,784 A * 8/1979 Gardner ..... E21B 43/112 166/117.5
4,220,201 A 9/1980 Hauk
5,014,780 A * 5/1991 Skipper ..... E21B 47/095 166/55.8
5,348,087 A * 9/1994 Williamson, Jr. ..... E21B 23/02 166/115
5,390,735 A * 2/1995 Williamson, Jr. ..... E21B 23/02 166/115
5,579,829 A * 12/1996 Comeau ..... E21B 23/02 166/117.6
5,732,770 A 3/1998 Beeman
6,155,150 A 12/2000 Cooper et al.
6,202,746 B1 * 3/2001 Vandenberg ..... E21B 7/061 166/117.6
6,615,933 B1 * 9/2003 Eddison ..... E21B 10/32 175/284
6,772,938 B2 8/2004 Bond
6,913,082 B2 * 7/2005 McGlothen ..... E21B 41/0035 166/313
7,490,676 B2 * 2/2009 Nobileau ..... E21B 17/08 166/292
7,581,591 B2 * 9/2009 Schwindt ..... B23D 11/00 166/298
7,740,059 B1 6/2010 Spencer
8,230,951 B2 * 7/2012 Radford ..... E21B 10/322 175/267
9,187,989 B2 11/2015 Lee
9,382,782 B2 7/2016 Pasvandi
9,598,939 B2 3/2017 Lee
9,611,725 B2 4/2017 Mlcak et al.
9,784,078 B2 10/2017 Holly et al.
10,167,690 B2 * 1/2019 Haq ..... E21B 17/1078
10,337,271 B2 * 7/2019 Robertson ..... E21B 29/00
2002/0144815 A1 * 10/2002 Van Drentham-Susman ..... E21B 23/04 166/241.1
2006/0254778 A1 * 11/2006 Nobileau ..... E21B 33/14 166/380
2008/0178721 A1 * 7/2008 Schwindt ..... E21B 43/112 83/191
2010/0089583 A1 4/2010 Xu et al.
2010/0200218 A1 * 8/2010 Palidwar ..... E21B 33/1265 166/126
2012/0037426 A1 * 2/2012 Ritchie ..... E21B 23/006 175/57
2012/0160516 A1 * 6/2012 Ravensbergen ..... E21B 23/02 166/380
2015/0101812 A1 * 4/2015 Bansal ..... E21B 47/095 166/298
2015/0300135 A1 * 10/2015 Micak ..... E21B 43/119 166/298
2016/0010408 A1 * 1/2016 Stokes ..... E21B 43/119 166/381
2016/0138369 A1 * 5/2016 Tunget ..... E21B 29/00 166/311
2016/0160620 A1 * 6/2016 Al-Gouhi ..... E21B 43/117 166/297
2016/0265294 A1 * 9/2016 Robertson ..... E21B 23/02
2016/0273293 A1 * 9/2016 Surjaatmadja ..... E21B 43/114
2016/0348455 A1 * 12/2016 Haq ..... E21B 17/1078
2018/0038221 A1 * 2/2018 Hughes ..... E21B 23/14
2018/0156000 A1 * 6/2018 Cleven ..... E21B 23/02
2018/0334881 A1 * 11/2018 Dallas ..... E21B 17/006
2019/0186224 A1 * 6/2019 Beazer ..... E21B 23/01
2019/0257177 A1 * 8/2019 Greci ..... E21B 29/005
2019/0323310 A1 * 10/2019 Robertson ..... E21B 23/01
2020/0102794 A1 * 4/2020 Dallas ..... E21B 43/112
2020/0102815 A1 * 4/2020 Hrupp ..... E21B 23/00
2020/0109613 A1 * 4/2020 Hrupp ..... E21B 43/112
2020/0149365 A1 * 5/2020 Wilson ..... E21B 29/005
2020/0190951 A1 * 6/2020 Teurlay ..... E21B 43/112

FOREIGN PATENT DOCUMENTS

WO WO-0229207 A1 * 4/2002 ..... E21B 17/08
WO WO-2012110867 A2 * 8/2012 ..... E21B 43/112
WO WO-2014077810 A1 * 5/2014 ..... E21B 43/112
WO WO-2015073011 A1 * 5/2015 ..... E21B 29/005

* cited by examiner

MECHANICAL PERFORATOR

CROSS REFERENCE TO RELATED APPLICATIONS

This is the first application for this invention.

FIELD OF THE INVENTION

This invention, relates in general to well casing perforators and, in particular, to a novel, mechanical perforator for use in casing strings that line hydrocarbon well bores.

BACKGROUND OF THE INVENTION

Well casing perforators are known in the art and are used to perforate a "casing string" that is inserted into a drilled hydrocarbon well bore to provide a smooth liner in the well bore and prevent the wellbore from collapsing. Casing strings are typically assembled using lengths of plain pipe having pin-threaded ends called "casing joints", which are interconnected using short tubular "casing collars" that have complimentarily box-threaded ends, though the casing joints may be box-threaded and the casing collars may be pin-threaded. The casing string is usually "cemented in" after it is run into a drilled well bore by pumping a cement slurry down through and up around the outside of the casing string. The cement slurry sets around the casing string and inhibits fluid migration behind the casing string within the wellbore. As is well understood in the art, once a casing string is cemented in the well bore, it provides a fluid-tight passage from the wellhead to a "toe" or bottom of the well. Consequently, the casing string must be perforated within any production zone(s) pierced by the well bore to permit hydrocarbon to flow from the production zone(s) into the casing string for production to the surface.

Known, mechanical perforators are designed to perforate plain casing strings. Normally, selected casing joints in a production zone are perforated somewhere between adjacent casing collars in the casing string. Although many different designs for mechanical casing perforators have been invented, none of them have gained widespread commercial use. Most mechanical perforators have a single cutter that punches only one hole at a time in the casing. One exception is disclosed in U.S. Pat. No. 9,598,939 which issued on Mar. 21, 2017 to Lee entitled "Downhole Perforating Tool and Method of Use", which teaches a mechanical perforator having four cutter blocks with sharp edges for simultaneously penetrating a casing joint. Each cutter block has opposed sides with inclined parallel grooves. The inclined parallel grooves respectively engage correspondingly inclined grooved edges of a cutter body that carries the respective cutter blocks. A hydraulic activation member driven by fluid pressure pumped from the surface forces the respective cutter blocks up the inclined, grooves of the cutter body to penetrate the casing. A compression spring returns the cutter blocks to a retracted position when the fluid pressure is released at the surface. As will be understood by those skilled in the art, this tool will not reset to the retracted position if there is differential pressure downhole that overpowers the compression spring.

There therefore exists a need for a mechanical perforator having a plurality of cutting blades that can be reliably moved from a retracted to a cutting position, and back to the retracted position to permit the mechanical perforator to be relocated in a cased wellbore.

SUMMARY OF THE INVENTION

It is therefore an object of the invention to provide a mechanical perforator having a plurality of cutting blades that can be reliably moved from a retracted to a cutting position, and back to the retracted position, to permit the mechanical perforator to be relocated in a cased wellbore.

The invention therefore provides a mechanical perforator comprising: at least one perforator blade supported within a perforator module having a perforator body that supports upper and lower perforator end cones that respectively slideably support a perforator blade holder for each of the at least one perforator blade, a linear force generator operatively connected to an uphole side of the perforator module to drive the perforator blades of the perforator module, and a slip module operatively connected to a downhole side of the perforator module to selectively anchor a downhole end of the mechanical perforator in a cased well bore.

The invention further provides a mechanical perforator comprising: a perforator module having three perforator blades adapted to mechanically perforate a well casing, the perforator module having a perforator body connected to a linear force generator, the perforator body supporting an upper perforator end cone threadedly connected to a linear force generator mandrel, and a lower perforator end cone that is supported on a free end of the linear force generator mandrel, the respective upper and lower perforator end cones respectively having three equally spaced apart T-slots that respectively receive a T-slider on opposed ends of three perforator blade holders that respectively support one of the three perforator blades; the linear force generator providing linear force to drive the three blades of the perforator module through a sidewall of the well casing; and, a slip module connected to an opposite side of the perforator module, the slip module releasably locking the mechanical perforator in the well casing when adequate fluid pressure is pumped into a central passage of the mechanical perforator.

The invention yet further provides a mechanical perforator comprising a perforator module and a slip module, the perforator module having a plurality of perforator blades respectively adapted to perforate a well casing joint, the perforator module including a perforator body that supports an upper perforator end cone and a lower perforator end cone, the upper and lower perforator end cones respectively comprising a plurality of T-slots that respectively receive T-sliders on opposed ends of a plurality of perforator blade holders that respectively support a one of the plurality of perforator blades, and a linear force generator connected to the perforator body and adapted to reciprocate the upper perforator end cone from a retracted condition to a deployed condition in which the respective perforator blades perforate the well casing joint.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a mechanical perforator with a plurality of perforator blades that simultaneously perforate a casing used to line a hydrocarbon well bore. Fluid pressure pumped into the mechanical perforator moves button slips to a deployed condition to bite the casing and lock the mechanical perforator in position for perforating the casing. A force multiplier moves the perforator blades from a retracted condition to a deployed condition in which the well casing is perforated, and back again to the retracted condition. After the casing is perforated, the mechanical perforator can be moved downhole to permit fracturing fluid to be pumped down an annulus of the casing string and through the perforation(s) in the casing joint to stimulate a section of the production zone behind the casing string. This process may be repeated until the entire production zone has been fractured and the well bore is ready for production. This mechanical perforator is useful in both well completions and well abandonments.

| Part No. | Part Description |
|---|---|
| 10 | Mechanical perforator |
| 12 | Perforator module |
| 14 | Slip module |
| 16 | Linear force generator |
| 17 | Linear force generator mandrel |
| 18 | Downhole tool termination components |
| 20 | Work string |
| 21 | Perforator body |
| 22 | Casing joint |
| 23 | Pin-threaded upper end of perforator body |
| 24a-24c | Perforator blades |
| 25 | Perforator body slots |
| 26a-26c | Perforator blade holders |
| 28a | Perforator blade tracks |
| 30 | Perforator blade track end |
| 34 | Upper perforator end cone |
| 35 | Perforator end cone ribs |
| 36 | Threaded connection |
| 38 | Lower perforator end cone |
| 39 | Crossover sleeve |
| 40 | Crossover body |
| 41 | Cross-over sleeve lower end |
| 42 | Transition sub |
| 44 | Transition sub thread connection |
| 46 | Crossover body mandrel |
| 48 | Velocity bypass sub |
| 50 | Velocity bypass valve |
| 52 | Velocity bypass valve spring |
| 54 | Velocity bypass valve ports |
| 56 | Velocity bypass choke |
| 58 | Terminal sub |
| 60 | Central passage |
| 61 | Slip module body |
| 62a-62c | Button slips |

-continued

| Part No. | Part Description |
|---|---|
| 63 | Slip retainer bar |
| 64 | Slip screws |
| 65 | Slip springs |
| 66 | Slip energizing port |
| 67 | Slip socket |
| 68 | Slip energizing chamber |
| 70 | T-slot |
| 72a, 72b | T-sliders |

Figure 1:
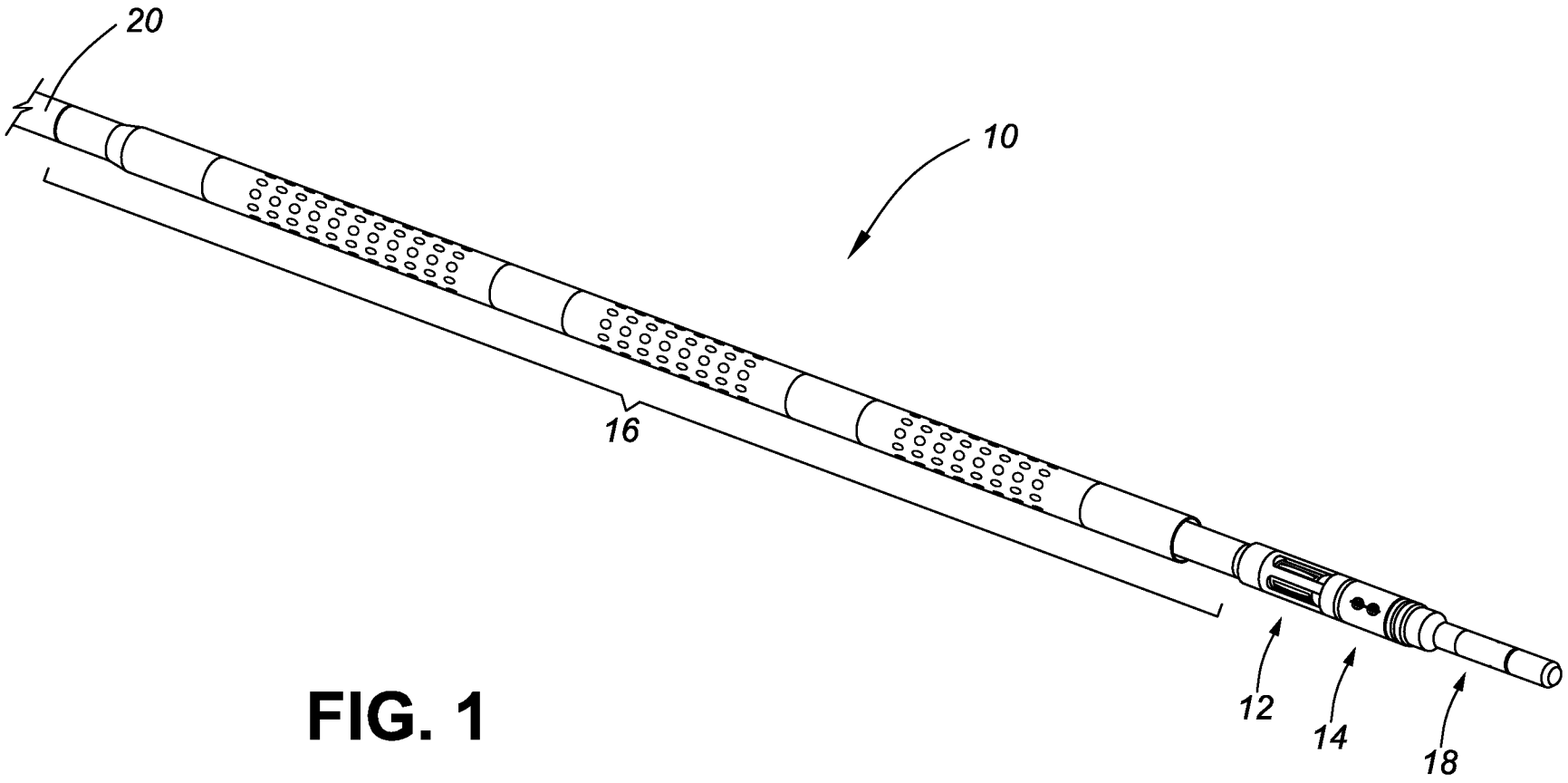
FIG. 1 is a perspective view of one embodiment of a mechanical perforator in accordance with the invention.

FIG. 1 is a perspective view of one embodiment of a mechanical perforator 10 in accordance with the invention. The mechanical perforator 10 includes a perforator module 12, which will be explained below with reference to FIGS. 2-5*c*, and 6. The perforator module 12 is connected to a slip module 14 on its downhole end, and to a linear force generator 16 on its uphole end. The slip module 14 locks the mechanical perforator 10 in a selected location in a cased well bore to permit the linear force generator 16 to be activated to drive the perforator module 12 to perforate the cased well bore. The slip module 14 will be explained below with reference to FIGS. 2 and 3. The linear force generator 16 provides linear force required to power the perforator module 12. The linear force generator 16 may be, for example, either one of the modular force multipliers described in Applicant's co-pending United States patent applications, the specifications of which are respectively incorporated herein by reference, namely: U.S. patent application Ser. No. 16/004,771 filed May 11, 2018 entitled "Modular Force Multiplier For Downhole Tools"; and, U.S. patent application Ser. No. 15/980,992 filed May 16, 2018 and also entitled "Modular Force Multiplier For Downhole Tools". Other prior art linear force generators may also be used, provided that they are adapted to generate adequate linear force by converting pumped fluid pressure into linear force, or translating work string pull or work string push force push into the bidirectional linear force required to operate the perforator module 12.

Connected to a downhole end of the slip module 14 are downhole tool termination components 18, the function of which will be explained below with reference to FIG. 2. Connected to an uphole end of the liner force generator 16 is a work string 20, which may be a coil tubing work string or jointed tubing work string, depending on operator choice and a length of the well bore. As understood by those skilled in the art, coil tubing work strings have a shorter "push reach" than most jointed tubing work strings. The work string 20 is used to push the mechanical perforator 10 into a well bore, manipulate a position of the mechanical perforator 10 within the well bore, pump fluid downhole to operate the slip module 14, and, in some embodiments apply pull or push force to operate the linear force generator 16 after the downhole end of the mechanical perforator 10 has been anchored in a cased well bore by the slip module 14.

Figure 2:
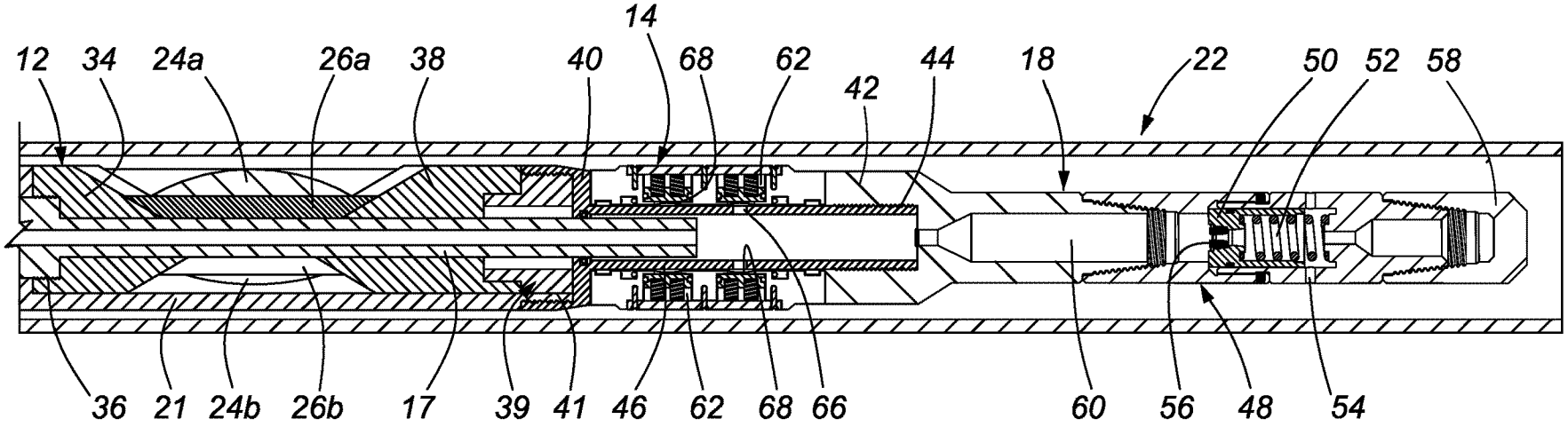
FIG. 2 is a cross-sectional view of a downhole end of the mechanical perforator shown in FIG. 1 in a cased well bore.

FIG. 2 is a cross-sectional view of a downhole end of the mechanical perforator 10 shown in FIG. 1, after insertion into a casing joint 22 of a cased well bore. In this embodiment the perforator module 12 has three perforator blades 24*a*-24*c* (only 24*a* and 24*b* can be seen in this view), as will be described below in more detail. It should be understood that the term "perforator blade" as used in this document does not necessarily mean an instrument with a sharp cutting edge, though an instrument with a sharp cutting edge is not excluded. Rather, perforator blade means an instrument designed to repeatedly penetrate a sidewall of the casing joint 22. In this exemplary embodiment, the perforator blades 24*a*-24*c* are arcuate wedge-shaped instruments constructed of wear resistant metal. Each perforator blade 24*a*-24*c* may optionally be coated, studded, or imbedded with diamond, carbide or like material to improve wear resistance and prolong a duty cycle of the perforator blades 24*a*-24*c*.

As will be explained below in more detail, each perforator blade 24*a*-24*c* is removably received in a respective perforator blade track 28*a* (see FIG. 4*c*) of respective blade holders 26*a*, 26*b*, 26*c*. The respective blade holders 26*a*-26*c* are connected to and reciprocate from a retracted condition shown to a deployed condition (see FIG. 6), on an upper perforator end cone 34 and a lower perforator end cone 38, as will be explained below in more detail. The respective upper perforator end, cone 34 and lower perforator end cone 38 are surrounded and supported by a slotted perforator body 21 (better seen in FIG. 3), which stabilizes the respective perforator end cones 34, 38 and inhibits unintended deployment of the perforator blades 24*a*-24*c*. The upper perforator end cone 34 is connected by a threaded connection 36 to a liner force generator mandrel 17 of the linear force generator 16 (see FIGS. 1 and 6). The lower perforator end cone 38 is supported on a free end of the linear force generator mandrel 17 and connected to an upper end of a crossover sleeve 39. The crossover sleeve 39 has a crossover sleeve lower end 41 that is contoured to provide support to a downhole end of the perforator body 21. The downhole end of the perforator body 21 and the crossover sleeve lower end 41 of the crossover sleeve 39 are threadedly connected to a crossover body 40 having a crossover body mandrel 46 that supports the slip module 14. A downhole end of the crossover body mandrel 46 is threadedly connected to a transition sub 42 of the downhole tool termination components 18 by a transition sub thread connection 44.

In this embodiment, the downhole tool termination components 18 include the transition sub 42 and a two-part velocity bypass sub 48. The velocity bypass sub 48 controls fluid flow through a central passage 60 of the mechanical perforator 10, which in turn controls a disposition of button slips 62 of the slip module 14, as will be explained below in more detail with reference to FIG. 3. The velocity bypass sub 48 includes a velocity bypass valve 50, which is normally urged to an open condition by a velocity bypass spring 52. The velocity bypass valve 50 lets fluid pumped into the central passage 60 flow through a replaceable velocity bypass choke 56 and out through velocity bypass ports 54 into an annulus of the casing joint 22. When a rate of flow through the central passage 60 surpasses a flow-rate threshold determined by a size of an orifice in the replaceable velocity bypass choke 56, the velocity bypass valve 50 is urged to a closed condition in which it obstructs the velocity bypass ports 54 and stops fluid flow through the central passage 60. Fluid pressure then builds in the central passage 60, which forces fluid through slip energizing ports 66 and into slip energizing chambers 68, urging the respective button slips 62 outwardly against an inner sidewall of the casing joint 22, the purpose of which will be explained below in more detail with reference to FIG. 6. A terminal sub 58 caps a lower end of the velocity bypass sub 48.

Figure 3:
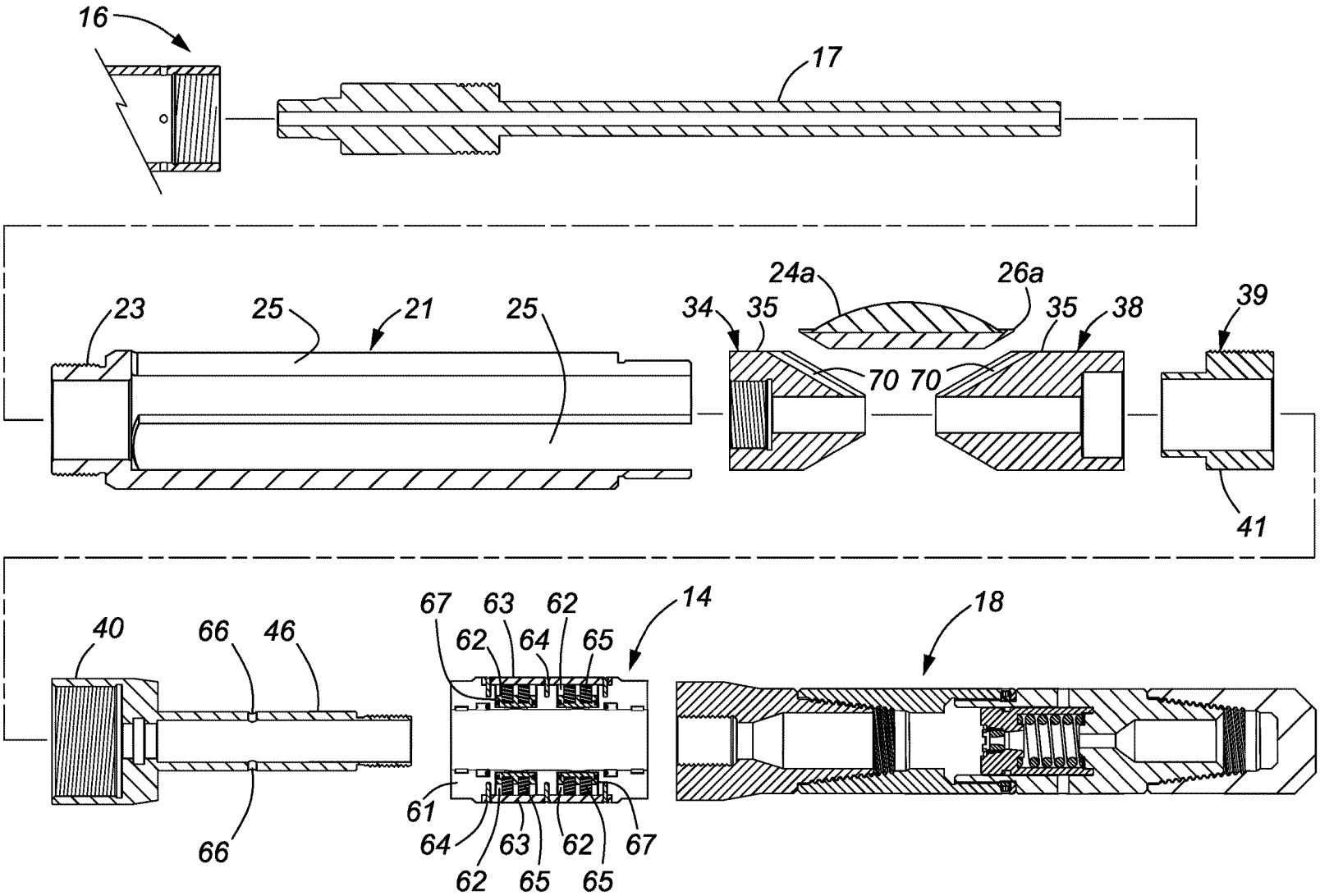
FIG. 3 is an exploded cross-sectional view of a perforator module of the mechanical perforator shown in FIG. 2.

FIG. 3 is an exploded cross-sectional view of the perforator module 12 of the mechanical perforator 10 shown in FIG. 2. The linear force generator 16 is threadedly connected to a pin-threaded upper end 23 of the perforator body 21. The respective upper perforator end cone 34 and lower perforator end cone 38 have end cone ribs 35 (better seen in FIG. 5*c*) that are respectively received in respective perforator body slots 25 in the perforator body 21. The perforator body slots 25 in the perforator body 21 permit the upper perforator end cone 34 to reciprocate within the perforator body 21, as will be explained below with reference to FIG. 6. The respective blade holders 26*a*-26*c* have T-sliders 72*a*, 72*b* (see FIGS. 4*a* and 4*c*) that are respectively received in T-slots 70 in the respective end cones 34 and 38. As explained above, the lower end 41 of the crossover sleeve 39 is contoured to support a lower end of the perforator body 21, having ribs like the end cone ribs 35 of the respective end cones 34, 38. The respective ribs on the lower end 41 of the crossover sleeve 39 are threaded to threadedly engage the crossover body 40. The crossover body mandrel 46 supports the slip module 14.

The slip module 14 includes a slip module body 61 supported on the crossover body mandrel 46. In one embodiment, the slip module 14 includes 4 button slips 62 arranged in adjacent pairs, though more, or fewer, may be provided as a matter of design choice. Each of the button slips 62 is U-shaped in cross-section and is retained in a respective slip socket 67 in the slip module body 61 by a slip retainer bar 63 secured in place by a plurality of slip screws 64. Slip springs 65 captured between the slip retainer bars 63 and the button slips 62 urge the respective button slips 62 to a normally retracted condition shown. The downhole tool termination components 18 are threadedly connected to the lower end of the crossover body mandrel 46, as explained above, which secures the slip module body 61 on the crossover body mandrel 46.

Figure 4A:
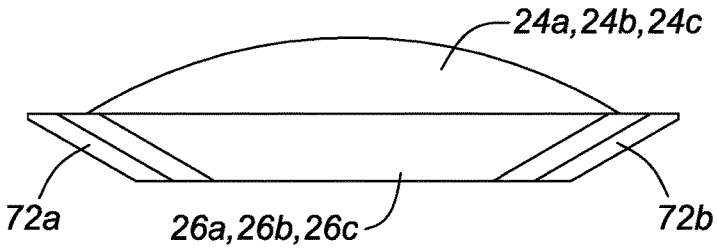
FIG. 4*a* is a side elevational view of a blade holder and perforator blade of the perforator module shown in FIG. 3.
Figure 4B:
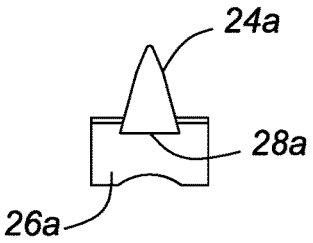
FIG. 4*b* is an end view of the blade holder and perforator blade of the perforator module shown in FIG. 4*a;*

FIG. 4*a* is a side elevational view of the blade holders 26*a*, 26*b* and 26*c* and the perforator blades 24*a*, 24*b* and 24*c* of the perforator module 12 shown in FIG. 3, showing the T-sliders 72*a*, 72*b* that run in the T-slots 70 in the respective upper perforator end cone 34 and the lower perforator end cone 38 shown in FIG. 3. FIG. 4*b* is an end view of the blade holder 26*a* and perforator blade 24*a* of the perforator module 12 shown in FIG. 3.

Figure 4C:
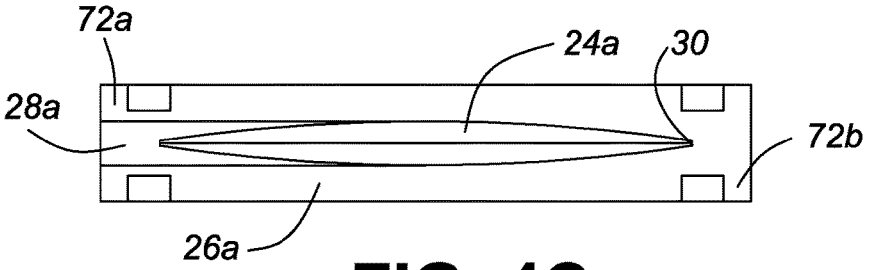
FIG. 4*c* is a top plan view of the blade holder and perforator blade of the perforator module shown in FIG. 4*a;*

FIG. 4*c* is a top plan view of the blade holder 26*a* and the perforator blade 24*a* of the perforator module 12. Each perforator blade holder 26*a*-26*c* has a perforator blade track 28*a* that removably receives the respective perforator blades 24*a*-24*c* and permit the perforator blades 24*a*-24*c* to be replaced as required. The respective perforator blade tracks 28*a* have a respective perforator blade track ends 30. In this embodiment, the perforator blade track end 30 is curved to conform to a contour of the perforator blade 24*a*, but this is a matter of design choice.

Figure 5A:
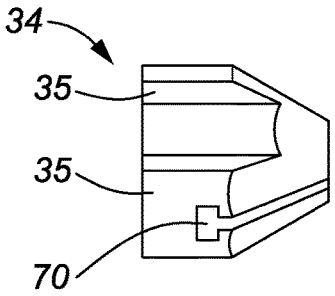
FIG. 5*a* is a side-elevational view of a perforator end cone shown in FIG. 3.

FIG. 5*a* is a side-elevational view of the upper perforator end cone 34 shown in FIG. 3. As explained above, each perforator end cone 34, 38 has end cone ribs 35 received in the respective perforator body slots 25 of the perforator body 21 shown in FIG. 3. In this embodiment, each end cone 34, 38 has three end cone ribs 35 and each end cone rib 35 includes a T-slot 70 that receives a T-slider 72 of one of the blade holders 26*a*-26*c*, as described above. The lower perforator end cone 38 has the same ribbed configuration.

Figure 5B:
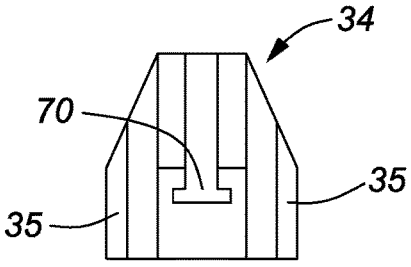
FIG. 5*b* is a top plan view of the perforator end cone shown in FIG. 5*a;*
Figure 5C:
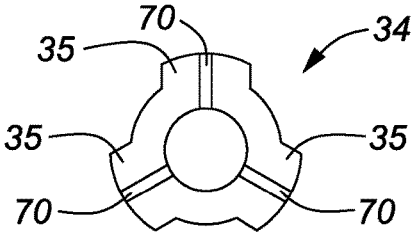
FIG. 5*c* is an end view of the perforator end cones shown in FIG. 3.

FIG. 5*b* is a top plan view of the upper perforator end cone 34 shown in FIG. 5*a*, and FIG. 5*c* is an inner end view of the perforator end cones 34, 38 shown in FIG. 3.

Figure 6:
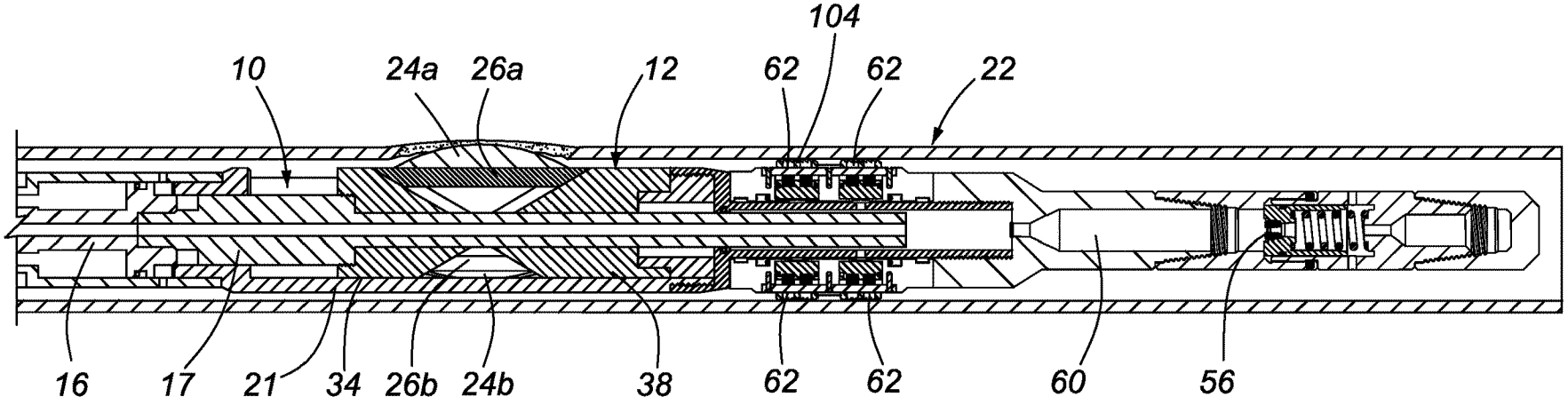
FIG. 6 is a cross-sectional view of the mechanical perforator shown in FIG. 2, after the mechanical perforator has perforated the cased well bore.

FIG. 6 is a cross-sectional view of the mechanical perforator 10 shown in FIG. 2, after the mechanical perforator 10 has perforated the well casing joint 22. Once the mechanical perforator 10 has been moved into a desired location in a cased wellbore using dead reckoning, or any other location determination method or apparatus, the button slips 62 are deployed against an inner surface of the casing joint 22 by pumping fluid through the work string 20 until the velocity bypass valve 50 closes and a fluid pressure of about 400-500 psi is maintained in the work string 20. Teeth of the button slips 62 bite into the casing joint 22 and anchor the downhole end of the mechanical perforator 10 in the casing joint. The linear force generator 16 is then operated, as taught in Applicant's co-pending patent applications incorporated herein by reference, to apply mechanical force against the upper perforator end cone 34 of the perforator module 12. This urges the upper perforator end cone 34 downhole towards the lower perforator end cone 38, thus urging the respective blade holders 26*a*-26*c* outwardly as their respective T-sliders 72*a*, 72*b* are forced upwardly through the respective T-slots 70 of the respective upper perforator end cone 34 and lower perforator end cone 38. The upward slide of the respective blade holders 26*a*-26*c* moves the respective perforator blades 24*a*-24*c* into contact with the inner sidewall of the casing joint 22. The advancing perforator blades 24*a*-24*c* tear the sidewall along the respective perforator blades 24*a*-24*c*, and open slots in the casing joint 22 through which a desired fluid may be pumped. The fluid may be a high-pressure fluid used to stimulate a production formation in the area of the casing joint 22, a cement solution used to abandon a well, or the like. After the casing joint 22 has been perforated, the linear force generator 16 is operated to return the respective blade holders 26*a*-26*c* to the retracted condition shown in FIG. 2, withdrawing the perforator blades 24*a*-24*c* from the perforations in the casing joint 22. Fluid pressure is relieved from the central passage 60, which returns the button slips 62 to their retracted condition, and the mechanical perforator 10 can be relocated in the cased well bore to perform another perforation or permit fluid to be pumped down an annulus of the cased well bore.

It should be understood that the mechanical perforator 10 can also be used as a casing ripper, provided that the casing joint 22 is not a heavy gauge pipe and it is at least about 4" (10 cm) in diameter to provide adequate strength in the components of the mechanical perforator 10 to support a ripping operation. When the mechanical perforator 10 is used as a casing ripper, fluid pressure in the central passage 60 is released to return the button slips 62 to the retracted condition as soon as the casing joint 22 has been perforated. The mechanical perforator 10 is then pulled up the casing string, or pushed down the casing string, depending on the operating stroke of the linear force generator 16, a desired distance to rip a desired length of the casing joint 22. The button slips 62 may be reset, if required, to move the perforator blades 24*a*-24*c* back to their retracted position using the linear force generator 16 after the ripping operation is completed.

The embodiments of the invention described above are only exemplary of a construction of the mechanical perforator 10 in accordance with the invention. Although an embodiment with three perforator blades has been described, embodiments with one, two or four blades are feasible. The scope of the invention is therefore intended to be limited solely by the scope of the appended claims.

I claim:

1. A mechanical perforator comprising: at least one perforator blade supported within a perforator module having a perforator body that supports upper and lower perforator end cones that respectively slideably support a perforator blade holder for each of the at least one perforator blade, a linear force generator operatively connected to an uphole side of the perforator module to drive the perforator blades of the perforator module, and a slip module operatively connected to a downhole side of the perforator module to selectively anchor a downhole end of the mechanical perforator in a cased well bore, and a slip module body supported on a crossover body mandrel of a crossover body connected to a lower end of the perforator body.

2. The mechanical perforator as claimed in claim 1 wherein the linear force generator comprises a linear force mandrel that extends through the upper perforator end cone and the lower perforator end cone, the linear force mandrel being threadedly connected to the upper perforator end cone and slideably supporting the lower perforator end cone.

3. The mechanical perforator as claimed in claim 1 wherein the upper and lower perforator end cones respectively comprise a T-slot that respectively receive a T-slider on opposed ends of the at least one perforator blade holder.

4. The mechanical perforator as claimed in claim 1 wherein the at least one perforator blade holder comprises a perforator blade track having a perforator blade track end, each perforator blade track removably receiving a respective one of the at least one perforator blade.

5. The mechanical perforator as claimed in claim 1 wherein the slip module body comprises at least one slip cavity that receives a button slip that releasably locks the mechanical perforator in the cased well bore when there is 400-500 psi of fluid pressure in a central passage of the mechanical perforator.

6. The mechanical perforator as claimed in claim 5 wherein the slip module further comprises a slip retainer bar for retaining the button slips in the respective slip cavities.

7. The mechanical perforator as claimed in claim 6 further comprising slip springs located between the slip retainer bar and the respective button slips.

8. A mechanical perforator comprising: a perforator module having three perforator blades adapted to mechanically perforate a well casing, the perforator module having a perforator body connected to a linear force generator, the perforator body supporting an upper perforator end cone threadedly connected to a linear force generator mandrel, and a lower perforator end cone that is supported on a free end of the linear force generator mandrel, the upper and lower perforator end cones respectively have three equally spaced apart T-slots that respectively receive a T-slider on opposed ends of three perforator blade holders that respectively support one of the three perforator blades; the linear force generator providing linear force to drive the three blades of the perforator module through a sidewall of the well casing; and, a slip module connected to an opposite side of the perforator module, the slip module releasably locking the mechanical perforator in the well casing when 400-500 psi of fluid pressure is pumped into a central passage of the mechanical perforator and a crossover sleeve having an upper end connected to a lower end of the lower perforator end cone and a lower end that supports a lower end of the perforator body.

9. The mechanical perforator as claimed in claim 8 further comprising a crossover body threadedly connected to the lower end of the crossover sleeve and the lower end of the perforator body.

10. The mechanical perforator as claimed in claim 9 wherein the crossover body comprises a crossover body mandrel that supports the slip module.

11. The mechanical perforator as claimed in claim 8 wherein the slip module comprises button slips normally urged to a retracted condition, each button slip responding to fluid pressure in a central passage of the mechanical perforator to move to a deployed condition adapted to bite into the well casing to lock the mechanical perforator in the well casing.

12. A mechanical perforator comprising a perforator module and a slip module, the perforator module having a plurality of perforator blades respectively adapted to perforate a well casing joint, the perforator module including a perforator body that supports an upper perforator end cone and a lower perforator end cone, the upper and lower perforator end cones respectively comprising a plurality of T-slots, each T-slot receiving a T-slider on an end of a perforator blade holder, each perforator blade holder receiving and supporting a perforator blade, and a linear force generator connected to the perforator body and adapted to reciprocate the upper perforator end cone from a retracted condition to a deployed condition in which the respective perforator blades perforate the well casing joint; and a crossover sleeve having an upper end connected to a lower end of the lower perforator end cone and a lower end that supports a lower end of the perforator body.

13. The mechanical perforator as claimed in claim 12 wherein the linear force generator comprises a linear force generator mandrel with a free end, the upper perforator end cone being threadedly connected to the linear force generator mandrel and the lower perforator end cone being slideably supported on the linear force generator mandrel free end.

14. The mechanical perforator as claimed in claim 12 further comprising a crossover body threadedly connected to the lower end of the crossover sleeve and the lower end of the perforator body.

15. The mechanical perforator as claimed in claim 14 wherein the crossover body comprises a crossover body mandrel that supports the slip module.

16. The mechanical perforator as claimed in claim 12 wherein the slip module comprises button slips arranged in adjacent pairs, the respective button slips normally being urged to a retracted condition by slip springs.

17. The mechanical perforator as claimed in claim 16 wherein the button slips are responsive to fluid pressure in a central passage of the mechanical perforator which urges the respective button slips to a deployed condition in which the button slips bite the well casing to releasably lock the perforator module in well casing.

* * * * *